US005765999A

United States Patent [19]

Ito et al.

[11] Patent Number: 5,765,999

[45] Date of Patent: Jun. 16, 1998

[54] SCROLL TYPE FLUID MACHINE HAVING SPIRAL WRAPS FORMED IN A STEP-LIKE SHAPE

[75] Inventors: Takahide Ito; Yukio Nagato, both of Nagoya; Tetsuzo Ukai, Nishi-Kasugai-gun, all of Japan

[73] Assignee: Mitsubishi Jukogyo Kabushiki Kaisha, Tokyo, Japan

[21] Appl. No.: 694,341

[22] Filed: Aug. 8, 1996

[30] Foreign Application Priority Data

| | | | |
|---|---|---|---|
| Aug. 31, 1995 | [JP] | Japan | 7-246978 |
| Dec. 4, 1995 | [JP] | Japan | 7-315210 |

[51] Int. Cl.[6] ..... F01C 1/04

[52] U.S. Cl. ..... 418/55.2

[58] Field of Search ..... 418/55.2

[56] References Cited

U.S. PATENT DOCUMENTS

| | | | |
|---|---|---|---|
| 5,370,512 | 12/1994 | Fujitani et al. | 418/55.2 |
| 5,421,707 | 6/1995 | Daniels | 418/55.2 |

FOREIGN PATENT DOCUMENTS

| | | | |
|---|---|---|---|
| 0 520 431 | 12/1992 | European Pat. Off. . | |
| 59-58187 | 4/1984 | Japan . | |
| 59-58791 | 4/1984 | Japan . | |
| 59058187 | 4/1984 | Japan . | |
| 61-171801 | 10/1986 | Japan . | |
| 63-201385 | 8/1988 | Japan | 418/55.2 |
| 2169886 | 6/1990 | Japan . | |
| 6-66273 | 3/1994 | Japan . | |

*Primary Examiner*—John J. Vrablik

*Attorney, Agent, or Firm*—Wenderoth, Lind & Ponack, L.L.P.

[57] ABSTRACT

Object: To provide a high performance scroll type fluid machine in which machining is facilitated, strength of central end portion of scroll wrap is high enough, volume of the innermost compression chamber becomes zero and yet compression efficiency does not lower.

Solving means: A central end portion profile of spiral wrap of each scroll (1, 2) is formed in a step-like shape having at least two steps (1A, 1B and 2A, 2B), the central end portion profile of each said step is made in a complete engagement profile and thickness of said step-like spiral wrap is made thinner at the upper step leaving an end plate.

13 Claims, 10 Drawing Sheets

SCROLL TYPE FLUID MACHINE HAVING SPIRAL WRAPS FORMED IN A STEP-LIKE SHAPE

BACKGROUND OF THE INVENTION

1. Field of the Invention

The present invention relates to a scroll central portion profile of a scroll type fluid machine, which is also applicable to a scroll type expander.

2. Description of the Prior Art

A scroll wrap central portion profile of a scroll type compressor, for example, has been disclosed variously as it has an important effect on the reliability and performance of the scroll. One example of a scroll disclosed in the Japanese laid-open patent application No. Sho 59(1984)-58187, as shown in FIG. 8, employs what is called a complete engagement profile, which is often employed for reason of performance, that is, while a swivel scroll, being prevented from making rotational motions, makes revolutional swivel motions around a stationary scroll in the order of (*a*), (*b*), (*c*) and (*d*), the volume of a compression chamber formed at the central end portion of both wraps becomes finally zero, as shown in FIG. 8(*d*).

However, in this type of scroll profile, there is caused a maximum stress at the central end portion of the scroll wrap, which often results in breakages. To overcome this problem and to secure a reliability, various means are disclosed to reduce the maximum stress generated and to increase the fatigue strength of material.

As for means to reduce the maximum stress generated, such means to move the connecting point of a curve to form a profile of the central end portion and an involute curve of the outer side thereof to the direction of a larger involute angle, such means of the Japanese laid-open patent application No. Hei 6(1994)-66273, as shown in FIG. 9, in which one of the swivel scroll and the stationary scroll which needs a larger strength is made thicker and the other is made thinner, etc. are disclosed.

In the Japanese laid-open utility model application No. Sho 61(1986)-171801, as shown in a sectional view of an engagement portion of spiral wraps of FIG. 10, there is disclosed a means to make a sectional profile of wrap in a trapezoidal form, which is not actually used because of difficulty in the machining.

Further, as for means to increase the fatigue strength of material, there is disclosed a means of the Japanese published utility model No. Hei 1(1989)-28315) (laid-open No. Sho 59(1984)-58791) in which a rib is provided at a root portion of wrap as shown in FIG. 11, but in this kind of structure, the rib provided at the wrap root portion cannot be a partition wall of pressure, that is, a complete engagement profile cannot be constructed thereby and there are problems that the compression efficiency is lowered due to increase of repressing power, etc.

FIG. 12 is a sectional view of the central portion of a spiral wrap of a scroll compressor in the prior art. As a central portion profile of scroll compressor, there are many cases where a complete engagement profile using an arc or a sinusoidal function is used, and FIG. 12 shows such a complete engagement profile. In FIG. 12, numeral 10 designates a base circle, numeral 30 designates a dorsal involute curve, numeral 31 designates a ventral involute curve, numeral 27 designates a dorsal involute connecting point, numeral 28 designates a ventral involute connecting point, numeral 47 designates a dorsal involute contact angle and numeral 48 designates a ventral involute contact angle.

In the complete engagement profile, the contact angle 47 of the dorsal involute curve and the central end portion curve and the contact angle 48 of the ventral involute curve and the central end portion curve are same and, according to accuracy of assembly or machining, there is a leakage of gas from a central compression chamber either to a dorsal compression chamber or to a ventral compression chamber. In this case, according to the direction to which the leakage occurs, ununiformity of performance or ununiformity of noise occurs.

In order to dissolve said ununiformity, there are made various ideas to make the direction of gas leakage constant by means of a portion of the complete engagement profile being cut out. But these ideas are only for a purpose to slightly move the angle of the point where the engagement is disengaged to the direction of a smaller angle than the contact angle and reliable control of leakage timing cannot be secured.

FIG. 13 is a plan view of a central portion of another example of spiral wrap of a scroll compressor in the prior art, wherein FIG. 13(*a*) is a plan view of a stationary scroll and FIG. 13(*b*) is a plan view of a swivel scroll. This shows an idea made for dissolving the above-mentioned problem. Numerals 17, 27 designate a dorsal involute connecting point, respectively, of the stationary scroll and of the swivel scroll and numerals 18, 28 designate a ventral involute connecting point, respectively, of the stationary scroll and of the swivel scroll. In this example, the contact angle 47 of the dorsal involute curve and the central portion curve and the contact angle 48 of the ventral involute curve and the central portion curve are different each other. While control of leakage timing is made securely by means of this profile, in the scroll having the connecting point 27 of a smaller contact angle, there is caused a large stress at the central end portion of the scroll wrap. So, in order to make a reliable profile, there is a need to make a design so that an enough strength is given to the scroll having the connecting point 27 of a smaller contact angle. Nevertheless, in case such design is made, there occurs a shortcoming that displacement volume of compressor becomes reduced or efficiency is lowered due to the compression ratio becoming smaller.

SUMMARY OF THE INVENTION

In order to dissolve the mentioned problems in the prior art, it is an object of the present invention to provide a high performance scroll type fluid machine in which machining is facilitated, strength of central end portion of scroll wrap is high, volume of the innermost compression chamber becomes zero and yet compression efficiency does not lower, and further to provide a profile by which control of leakage timing can be done securely.

In order to attain the above object, the present invention relates to a scroll type fluid machine having features as follows:

(1) In a scroll type fluid machine in which a stationary scroll and a swivel scroll, each composed of an end plate on which a spiral wrap is provided standingly, are engaged with each other eccentrically and with a deviation of phase so that a ventral closed space and a dorsal closed space are defined, said swivel scroll makes revolutional swivel motions while it is prevented from making rotational motions and thereby gas taken from a suction port into said ventral closed space and said dorsal closed space is compressed or expanded and discharged from a discharge port, a feature is that a sectional profile of a central end portion of the spiral wrap of each scroll is formed in a step-like shape having at least two steps, a profile of the central end portion of the spiral wrap of each step is a complete engagement profile in which volume of the innermost closed space formed by combining said ventral closed space and said dorsal closed space in the engagement state of both scrolls becomes substantially zero and thickness of said step-like portion of the spiral wrap becomes thinner at the upper step leaving the end plate.

(2) In the scroll type fluid machine mentioned in (1) above, another feature is that said spiral wrap is formed in involute curves, the central end portion side of the involute start points decided by the involute angles is formed connectedly by at least two curves and the sectional profile of the central end portion side of the involute start points is formed in said step-like shape.

(3) In the scroll type fluid machine mentioned in (1) above, still another feature is that said scroll type fluid machine is a compressor in which gas is taken from the suction port at the time when said ventral closed space and said dorsal closed space are at the outermost position, volume of said spaces is reduced as said ventral closed space and said dorsal closed space move to the central portion and compressed gas is discharged from the discharge port provided at the central portion of the end plate of the stationary scroll.

(4) In a scroll type fluid machine in which a stationary scroll and a swivel scroll, each composed of an end plate on which a spiral wrap is provided standingly, are engaged with each other eccentrically and with a deviation of phase so that a ventral closed space and a dorsal closed space are defined, said swivel scroll makes revolutional swivel motions while it is prevented from making rotational motions and thereby gas taken from a suction port into said ventral closed space and said dorsal closed space is compressed or expanded and discharged from a discharge port, a feature is that a profile of a central end portion of the spiral wrap of each scroll is formed in a step-like shape having at least two steps, a profile of the central end portion of the spiral wrap of each step is a complete engagement profile in which volume of the innermost closed space formed by combining said ventral closed space and said dorsal closed space in the engagement state of both scrolls becomes substantially zero and a profile of at least one step out of said at least two steps is formed in a shape in which a contact angle of a dorsal involute curve and a central portion curve and a contact angle of a ventral involute curve and a central portion curve are different each other.

(5) In the scroll type fluid machine mentioned in (4) above, another feature is that, with respect both to said stationary scroll and said swivel scroll, said contact angle of said dorsal involute curve and said central portion curve is made smallest at the lowermost step which is nearest to said end plate on which said spiral wrap is provided standingly and is made larger at the upper step leaving said end plate, on the other hand, said contact angle of said ventral involute curve and said central portion curve is made largest at the lowermost step and is made smaller at the upper step.

(6) In the scroll type fluid machine mentioned in (5) above, still another feature is that the smallest value of said contact angle of said dorsal involute curve and said central portion curve of the spiral wrap of said swivel scroll is made smaller than the smallest value of said contact angle of said dorsal involute curve and said central portion curve of the spiral wrap of said stationary scroll.

(7) In the scroll type fluid machine mentioned in (6) above, further feature is that, with respect to said swivel scroll, only the profile of the lowermost step in which said contact angle of said dorsal involute curve and said central portion curve is smallest is not the complete engagement profile but a profile in which the engagement is disengaged at a connecting point so that gas is passable to a compression chamber adjacent to the outer circumferential side and, with respect to said stationary scroll, only the profile of the uppermost step in which said contact angle of said dorsal involute curve and said central portion curve is largest is not the complete engagement profile but a profile in which the engagement is disengaged at a connecting point so that gas is passable to a compression chamber adjacent to the outer circumferential side.

DESCRIPTION OF THE PREFERRED EMBODIMENTS

Figure 1:
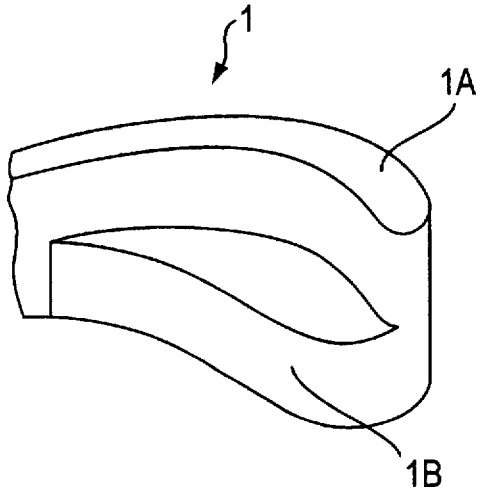
FIG. 1 is a partial perspective view showing a central portion of a stationary scroll wrap of a first preferred embodiment according to the present invention.
Figure 2:
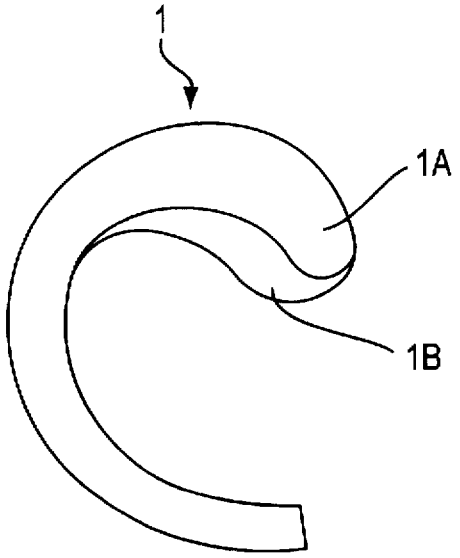
FIG. 2 is a plan view of the stationary scroll wrap of FIG. 1.
Figure 3A:
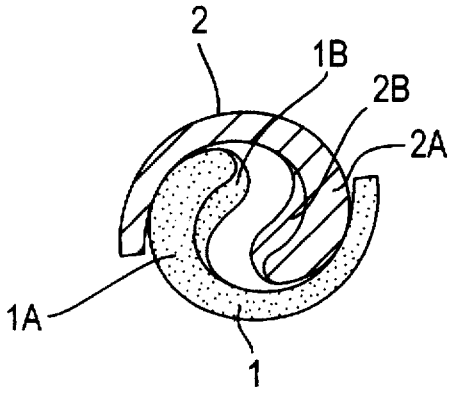
FIG. 3 is an explanatory view showing changes of engagement state of the stationary scroll of FIG. 1 and its opponent swivel scroll.
Figure 3B:
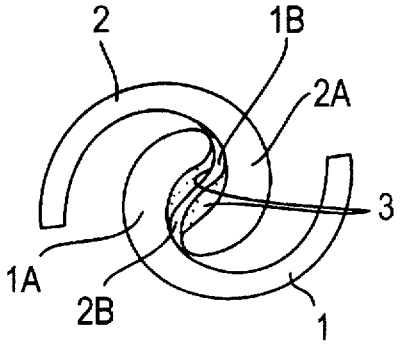
Figure 3C:
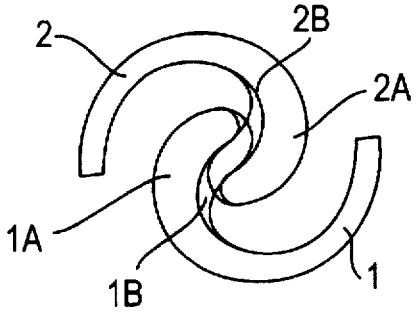
Figure 4:
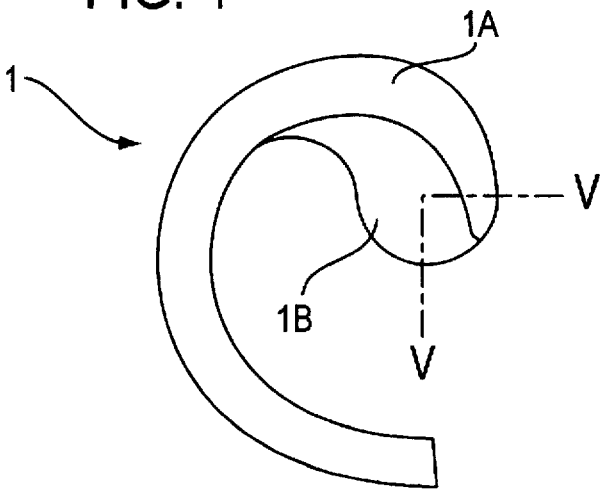
FIG. 4 is a plan view showing a central portion of a stationary scroll of another profile of the first preferred embodiment.
Figure 5A:
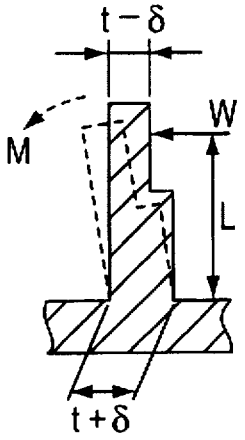
FIG. 5 is a view for comparison, wherein FIG. 5(*a*) is a sectional view of a scroll wrap taken along line V—V of FIG. 4 and FIG. 5(*b*) is a sectional view of a scroll wrap in the prior art.
Figure 5B:
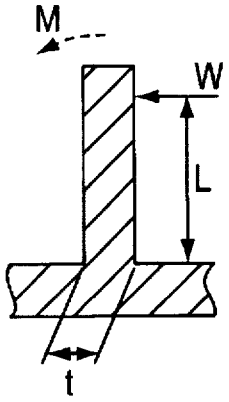
FIG. 5(b) (PRIOR ART)

FIG. 1 is a partial perspective view showing a central portion of a stationary scroll wrap of a first preferred embodiment according to the present invention. FIG. 2 is a plan view of the stationary scroll wrap of FIG. 1. FIG. 3 is an explanatory view showing changes of engagement state of the stationary scroll of FIG. 1 and its opponent swivel scroll. FIG. 4 is a plan view showing a central portion of a stationary scroll of another profile of the first preferred embodiment and FIG. 5 is a view for comparison, wherein FIG. 5(*a*) is a sectional view of a scroll wrap taken along line V—V of FIG. 4 and FIG. 5(*b*) is a sectional view of a scroll wrap in the prior art.

The central end portion of the stationary scroll wrap 1 according to the present invention has a shape shown in FIGS. 1 and 2 and its cross section is step-like. A swivel scroll wrap has also a same shape. FIG. 3 shows various engagement state of both scroll wraps. In FIG. 3, numeral 1 designates the stationary scroll, numeral 1A designates a wrap of upper step of the stationary scroll, numeral 1B designates a wrap of lower step of the stationary scroll, numeral 2 designates a swivel scroll, numeral 2A designates a wrap of upper step of the swivel scroll, numeral 2B designates a wrap of lower step of the swivel scroll and numeral 3 designates a compression chamber.

As shown in FIG. 3, the stationary scroll 1 and the swivel scroll 2, each having a central end portion profile as mentioned above, make a complete engagement with each other between the wrap of upper step 1A of the stationary scroll and the wrap of lower step 2B of the swivel scroll and between the wrap of lower step 1B of the stationary scroll and the wrap of upper step 2A of the swivel scroll, and the swivel scroll 2 makes revolutional swivel motions without making rotational motions around the stationary scroll 1 in the order of FIG. 3(*a*), (*b*) and (*c*). At this time, volume of the innermost compression chamber 3 shown in FIG. 3(*b*) becomes zero as shown in FIG. 3(*c*).

FIG. 4 shows an example of a scroll profile in which the wrap of upper step 1A and the wrap of lower step 1B of the stationary scroll of FIG. 2 are extremely different each other in the thickness of wrap. Even with this profile, the complete engagement is attained and it is understood that this profile is of an extremely high freedom of design. Further, the wraps of the mentioned preferred embodiments are all with two steps but the present invention is not limited thereto but includes cases of three or more steps.

Further, though not shown in the figure, there is no limitation that the central portion profiles of the swivel scroll and the stationary scroll are same and it is possible that the wrap of the lower step of the scroll which needs strength is thicker than the wrap of the lower step of the other scroll.

The feature of the mentioned preferred embodiments according to the present invention is, as mentioned in FIG. 5(*a*), that, in order to increase the strength of the central portion of the spiral wrap, while the thickness of the tip step portion of the wrap central end portion is made thinner to ($t-\delta$, the thickness of the root step portion of the wrap central end portion is made thicker to ($t+\delta$). Further, while the outer side face of the spiral wrap is made in a curve without a step, the inner side face is made with steps so that the thickness is reduced stepwise from the root portion to the tip portion. Thereby, the machining is facilitated and a wrap of which central end portion is strong enough can be obtained.

Incidentally, as shown in FIG. 5(*a*), where a bending moment is M, a cross section coefficient is Z and a stress is $\sigma$, the stress a is expressed symborically by $\sigma=M/Z$. That is, if the thickness t is made larger, Z becomes larger and $\sigma$ becomes smaller, and this can be applied to a scroll of a complete engagement profile. FIG. 5(*b*) is a sectional view of a wrap in the prior art.

According to the preferred embodiments mentioned above, as the root portion of the scroll wrap can be formed thicker, the wrap rigidity can be made higher and the stress generated at the wrap central end portion can be suppressed lower. Further, as the respective step engagement portion of the stationary scroll and the swivel scroll is made in a complete engagement form, the volume of the innermost compression chamber becomes zero and occurrence of power loss due to re-expansion can be prevented. And all the steps are made so that the thickness is reduced stepwise from the root portion to the tip portion, thereby the machining can be made easily by the conventional machine tools and scrolls of high performance and high strength can be provided inexpensively.

Figure 6A:
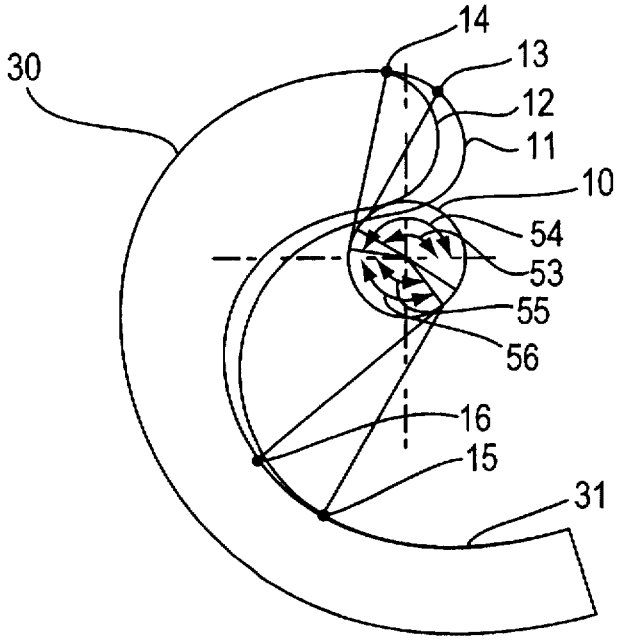
FIG. 6 is a plan view of a central portion of spiral wrap of a scroll compressor of a second preferred embodiment according to the present invention, wherein FIG. 6(*a*) is a partial plan view of a stationary scroll and FIG. 6(*b*) is that of a swivel scroll.
Figure 6B:
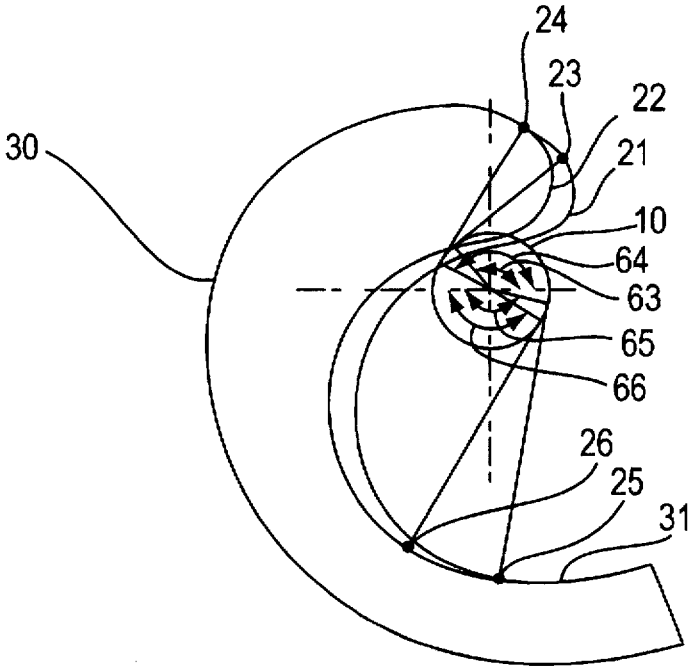
Figure 7:
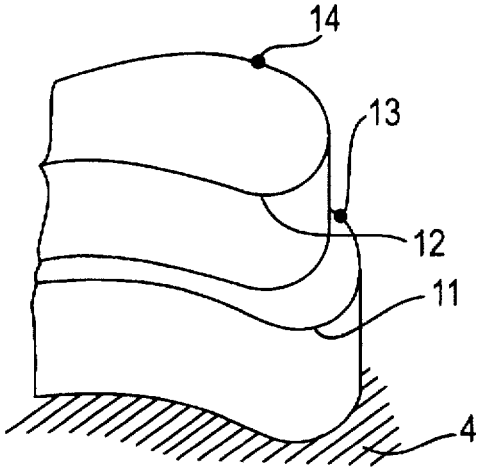
FIG. 7 is a partial perspective view of the spiral wrap of FIG. 6(*a*).
Figure 8A:
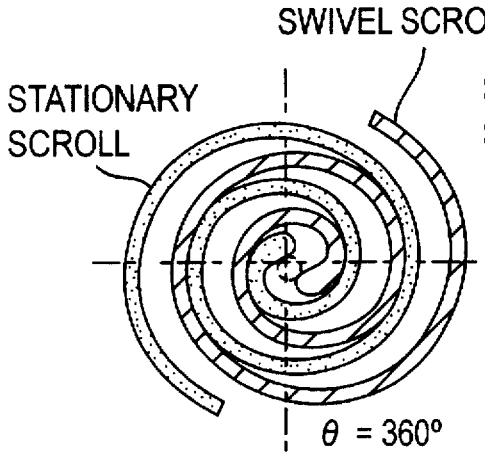
FIG. 8(a) (PRIOR ART)
FIG. 8 is an explanatory view of revolutional swivel motions without rotational motions of swivel scroll of a scroll type compressor disclosed in the Japanese laid-open patent application No. Sho 59(1984)-58187.
Figure 8B:
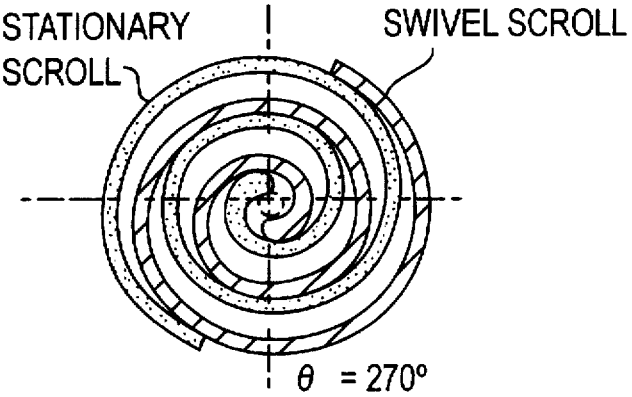
FIG. 8(b) (PRIOR ART)
Figure 8D:
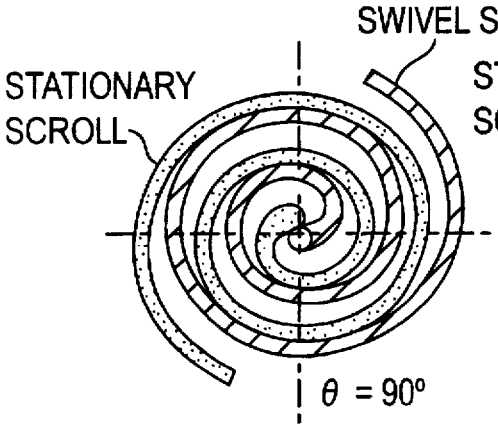
FIG. 8(d) (PRIOR ART)
Figure 8C:
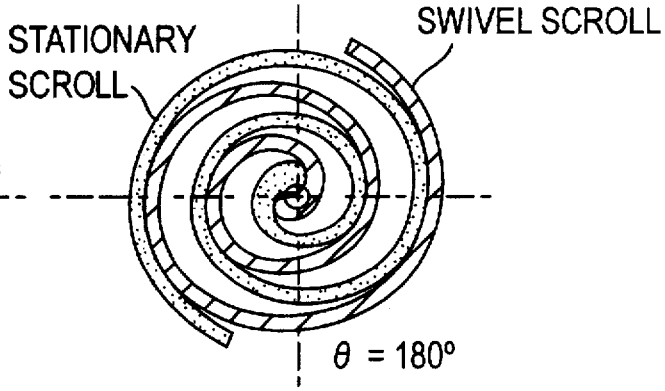
FIG. 8(c) (PRIOR ART)
Figure 9A:
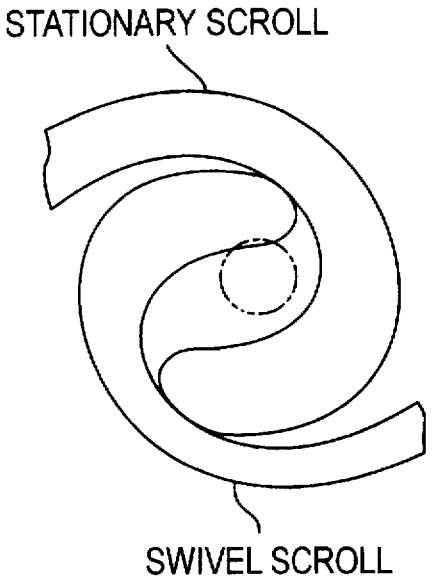
FIG. 9(a) (PRIOR ART)
FIG. 9 is an explanatory view of revolutional swivel motions without rotational motions of swivel scroll of a scroll type compressor disclosed in the Japanese laid-open patent application No. Hei 6(1994)-66273.
Figure 9C:
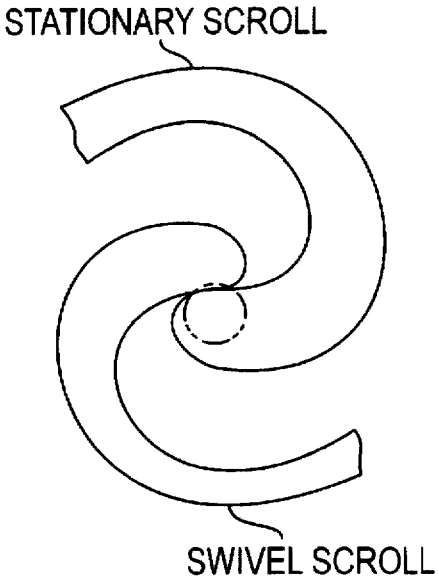
FIG. 9(c) (PRIOR ART)
Figure 9B:
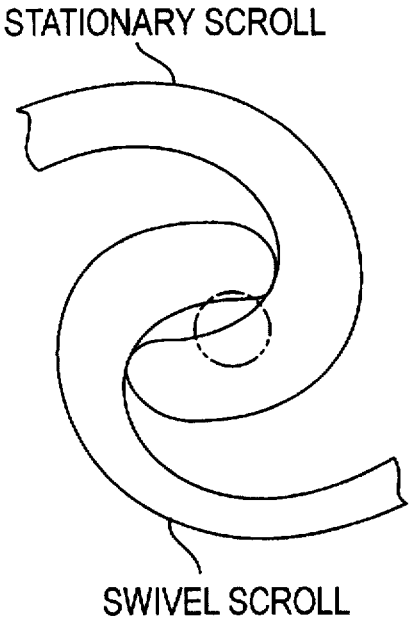
FIG. 9(b) (PRIOR ART)
Figure 9D:
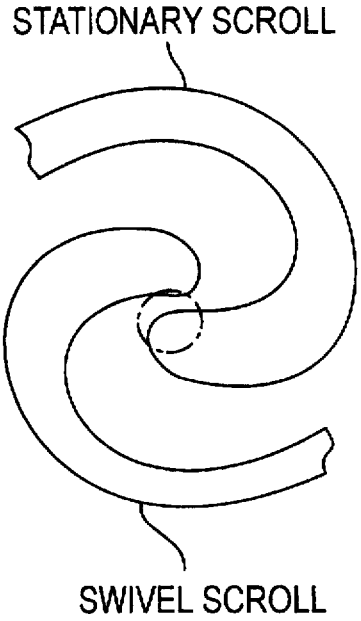
FIG. 9(d) (PRIOR ART)
Figure 10A:
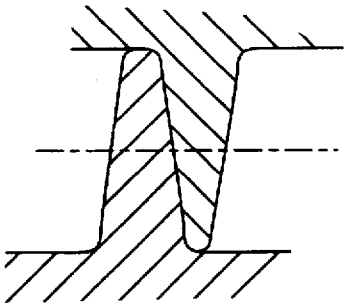
FIG. 10(a) (PRIOR ART)
FIG. 10 is a view showing sectional views of engaged scrolls disclosed in the Japanese laid-open utility model application No. Sho 61 (1986)-171801.
Figure 10B:
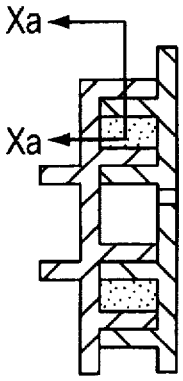
FIG. 10(b) (PRIOR ART)
Figure 11A:
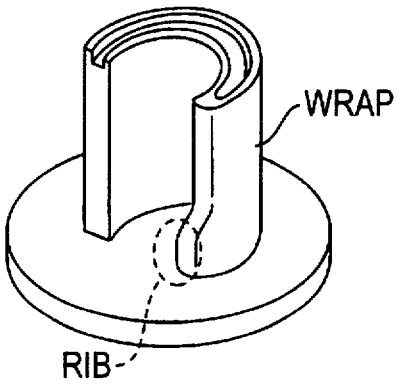
FIG. 11(a) (PRIOR ART)
FIG. 11 is a perspective view showing a scroll disclosed in the Japanese utility model publication No. Hei 1(1989)-28315 (laid-open No. Sho 59(1984)-58791).
Figure 11B:
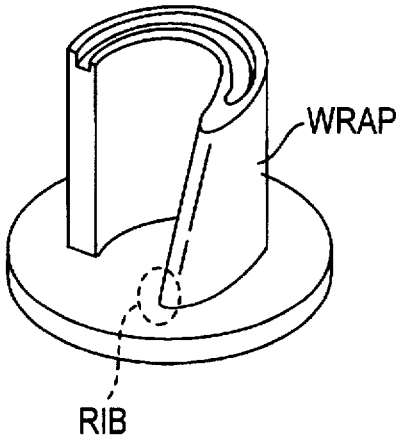
FIG. 11(b) (PRIOR ART)
Figure 11C:
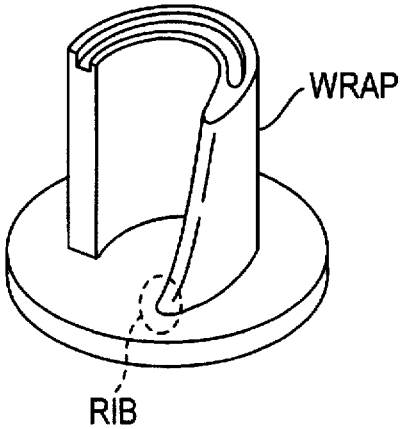
FIG. 11(c) (PRIOR ART)
Figure 12:
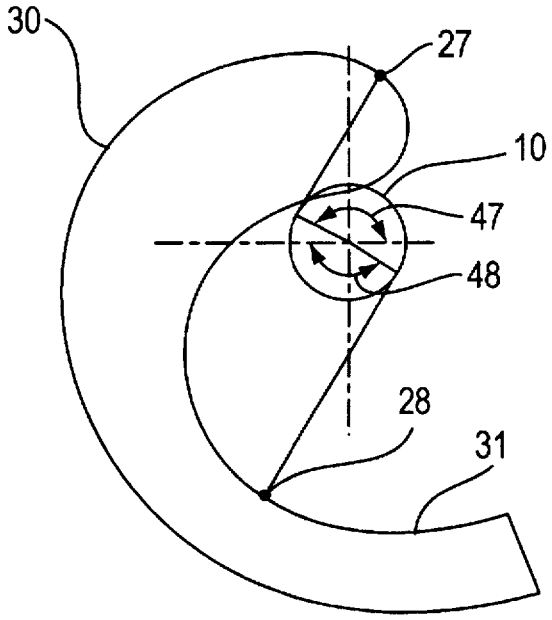
FIG. 12 (PRIOR ART)
FIG. 12 is a plan view of a central portion of a spiral wrap of a scroll compressor in the prior art.
Figure 13A:
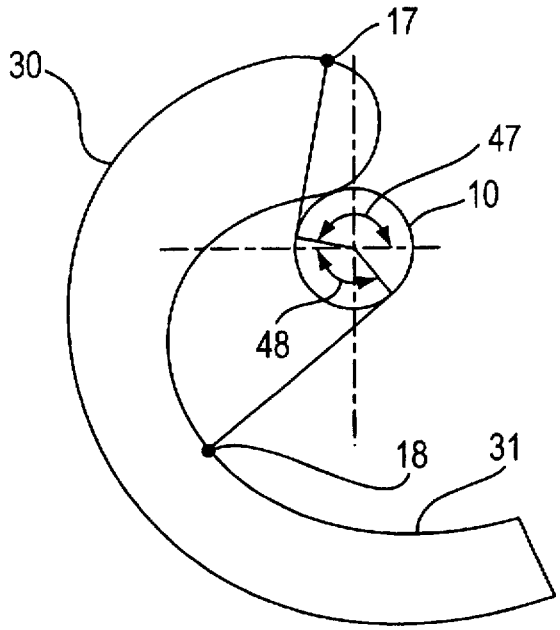
FIG. 13(a) (PRIOR ART)
FIG. 13 is a plan view of a central portion of another example of spiral wrap of a scroll compressor in the prior art, wherein FIG. 13(*a*) is a partial plan view of a stationary scroll and FIG. 13(*b*) is that of a swivel scroll.
Figure 13B:
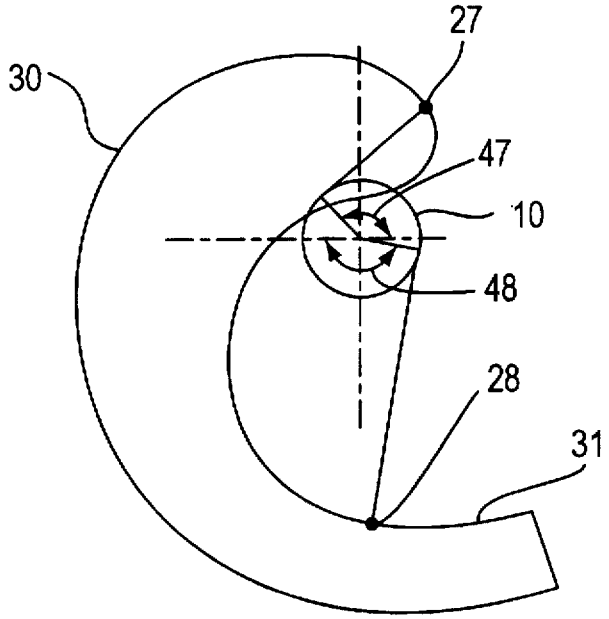
FIG. 13(b) (PRIOR ART)

FIG. 6 is a plan view of a central portion of spiral wrap of a scroll compressor of a second preferred embodiment according to the present invention, wherein FIG. 6(*a*) is a partial plan view of a stationary scroll and FIG. 6(*b*) is that of a swivel scroll. FIG. 7 is a partial perspective view of the spiral wrap of FIG. 6(*a*). The central end portion of each said wrap is composed of two steps, each having a different profile. In FIG. 6, numeral 10 designates a base circle, numeral 30 designates a dorsal involute curve and numeral 31 designates a ventral involute curve. These are same both for the stationary scroll and the swivel scroll.

In FIG. 6(*a*), numerals 11 and 12 designate a profile of central portion curve, respectively, of a lower step and an upper step. Numerals 13, 14, 15 and 16 designate an involute connecting point, respectively, of a lower step dorsal side, an upper step dorsal side, a lower step ventral side and an upper step ventral side. Numerals 53, 54, 55 and 56 designate a contact angle of the involute curve and the central portion curve, respectively, of the lower step dorsal side, the upper step dorsal side, the lower step ventral side and the upper step ventral side. All these are of a stationary scroll.

In FIG. 6(*b*), numerals 21 and 22 designate a profile of central portion curve, respectively, of a lower step and an upper step. Numerals 23, 24, 25 and 26 designate an involute connecting point, respectively, of a lower step dorsal side, an upper step dorsal side, a lower step ventral side and an upper step ventral side. Numerals 63, 64, 65 and 66 designate a contact angle of the involute curve and the central portion curve, respectively, of the lower step dorsal side, the upper step dorsal side, the lower step ventral side and the upper step ventral side. All these are of a swivel scroll.

In this preferred embodiment, as to the profile of the stationary scroll of FIG. 6(*a*), the involute contact angles are selected as shown in Table 1 below:

TABLE 1

Involute contact angle in the profile of stationary scroll

| Involute contact angle (numeral) | Degree of size | Example of angle | Remarks |
|---|---|---|---|
| Upper step dorsal side (54) | Large | 170° | |
| Lower step dorsal side (53) | Middle | 150° | Equal |
| Lower step ventral side (55) | Middle | 150° | |
| Upper step ventral side (56) | Small | 130° | |

Further, as to the profile of the swivel scroll of FIG. 6(*b*), the involute contact angles are selected as shown in Table 2 below:

TABLE 2

Involute contact angle in the profile of stationary scroll

| Involute contact angle (numeral) | Degree of size | Example of angle | Remarks |
|---|---|---|---|
| Upper step dorsal side (64) | Middle | 150° | Equal |
| Lower step dorsal side (63) | Small | 130° | |
| Lower step ventral side (65) | Large | 170° | |
| Upper step ventral side (66) | Middle | 150° | |

According to this preferred embodiment, as the contact angle with the involute curve is different between the dorsal side and the ventral side, a secured control of leakage angle and direction becomes possible independently of accuracy of machining or assembly.

Generally, by use of such construction that the central portion of the spiral wrap is formed with at least two steps, each having a different profile and being lapped in the height direction, the profile of the respective step and its opponent step in the engagement of the stationary scroll and the swivel scroll is made in what is called a complete engagement profile in which the compression volume becomes finally zero and a profile of at least one step out of said steps is formed in a profile in which the contact angle of the dorsal involute curve and the central portion curve and the contact angle of the ventral involute curve and the central portion curve are different each other, the direction and timing of gas leakage can be controlled securely.

Further, in said scroll type fluid machine, by use of such construction that, with respect both to the stationary scroll and the swivel scroll, the contact angle of the dorsal involute curve and the central portion curve is made smallest at the lowermost step which is nearest to the end plate on which the spiral wrap is provided standingly and is made larger at the upper step leaving the end plate, on the other hand, the contact angle of the ventral involute curve and the central portion curve is made largest at the lowermost step and is made smaller at the upper step, the wrap becomes thicker at the step nearer to the end plate so that strength is increased, and cutting and grinding work is also facilitated.

Furthermore, by use of such construction that the smallest value of the contact angle of the dorsal involute curve and the central portion curve of the swivel scroll wrap is made smaller than the smallest value of the contact angle of the dorsal involute curve and the central portion curve of the stationary scroll wrap, gas connection between the dorsal side compression chamber and the central portion compression chamber of the stationary scroll occurs earlier than that between the ventral side compression chamber and the central portion compression chamber, thus power loss due to excessive compression in the dorsal side compression chamber as so far easily occurred can be reduced.

Furthermore, by use of such construction that, with respect to the swivel scroll, only the profile of the lowermost step in which the contact angle of the dorsal involute curve and the central portion curve is not the complete engagement profile but a profile in which the engagement is disengaged at the connecting point so that the gas is passable to the compression chamber adjacent to the outer circumferential side and, with respect to the stationary scroll, only the profile of the uppermost step in which the contact angle of the dorsal involute curve and the central portion curve is largest is not the complete engagement profile but a profile in which the engagement is disengaged at the connecting point so that the gas is passable to the compression chamber adjacent to the outer circumferential side, the gas connection can be done securely at the angle at which a control is to be done.

According to the present invention, following effect is obtained:

(1) By the sectional profile of the scroll wrap being formed in a step-like shape having at least two steps, the wrap root portions both of the swivel scroll and the stationary scroll can be made thicker, so that the wrap rigidity becomes high and less stress is generated at the wrap central end portion. Although the wrap is thin at the step position which is apart from the end plate and the stress concentration position of that portion is the root portion thereof, as the height of the wrap is short and the stress lowers at the ratio of square of the wrap height, there is no substantial problem of strength. And by respective step and its opponent step of both scroll wraps being formed in the complete engagement profile, compression can be continued until the central portion volume becomes zero, thereby re-expansion of gas is eliminated and a high efficiency is attained.

(2) By the construction that the central portion of the spiral wrap is formed in a step-like shape having at least two steps, each having a different profile, the profile of the respective step and its opponent step in the engagement of the stationary scroll and the swivel scroll is made in what is called a complete engagement profile in which the compression volume becomes finally zero and a profile of at least one step out of said steps is formed in a profile in which the contact angle of the dorsal involute curve and the central portion curve and the contact angle of the ventral involute curve and the central portion curve are different each other, an enough wrap strength is obtained and the direction and timing of gas leakage can be controlled securely without damaging the efficiency.

It is understood that the invention is not confined to the particular construction and arrangement of parts herein illustrated and described but embraces such modified forms thereof as come within the scope of the following claims.

What is claimed is:

1. An arrangement for a scroll type fluid machine, comprising:

a stationary scroll comprising a first end plate and a first spiral wrap on said first end plate, said first spiral wrap having a first central end portion; and a swivel scroll comprising a second end plate and a second spiral wrap on said second end plate, said second spiral wrap having a second central end portion;

wherein said first and second spiral wraps are eccentrically engaged with each other with a phase deviation such that ventral and dorsal closed spaces are defined, whereby revolutional swivel motion of said swivel scroll, when prevented from rotating, can cause gas from a suction port to be taken into the ventral and dorsal closed spaces and compressed and discharged from a discharge port, and such that an innermost closed space is formed during revolution by combining the dorsal and ventral closed spaces for discharge to the discharge port;

wherein each of said first and second central end portions of said first and second spiral wraps form complete engagement profiles by which the volume of the innermost closed space can become substantially zero during revolution of said swivel scroll; and wherein each of said first and second central end portions of said first and second spiral wraps have a step-shaped sectional profile that comprises at least two steps, said complete engagement profiles comprising said step-shaped sectional profiles, and said at least two steps comprise one step adjacent to the respective said end plate and a second step further from the respective said end plate that is thinner than said one step.

2. The arrangement of claim 1, wherein each said spiral wrap forms an involute curve having involute start points at said central end portion determined by involute angles connected and formed by at least two curves, and wherein said central end portion has a step-shaped sectional profile at said involute start points.

3. The arrangement of claim 1, wherein said stationary scroll has a discharge port provided in said first end plate thereof and said stationary and swivel scrolls are engaged with each other and disposed in a compressor in relation to a suction port and said discharge port such that when the ventral closed space and the dorsal closed space are at an outer most position, gas can be taken from said suction port, whereby upon revolution of said swivel scroll relative to said stationary scroll the volume of the ventral closed space and the dorsal closed space is reduced as the ventral closed space and the dorsal closed space move toward said central end portions and the compressed gas is discharged from said discharge port.

4. The arrangement of claim 1, wherein said first and second spiral wraps have said step-shaped sectional profiles only at said first and second central and portions thereof, whereby a majority of said first and second spiral wraps are free from steps.

5. The arrangement of claim 1, wherein ones of said at least two steps of said sectional profiles of said first and second central end portions of said first and second spiral wraps that are closest to their respective said end plates are on ventral sides of said first and second spiral wraps, respectively.

6. The arrangement of claim 5, wherein said spiral wraps each have a dorsal involute curve, a central portion curve and a ventral involute curve, and the ones of said at least two steps extend along said ventral involute curve and said central portion curve.

7. An arrangement for a scroll type fluid machine, comprising:

a stationary scroll comprising a first end plate and a first spiral wrap on said first end plate, said first spiral wrap having a first central end portion; and a swivel scroll comprising a second end plate and a second spiral wrap on said second end plate, said second spiral wrap having a second central end portion;

wherein said first and second spiral wraps are eccentrically engaged with each other with a phase deviation such that ventral and dorsal closed spaces are defined, whereby revolutional swivel motion of said swivel scroll, when prevented from rotating, can cause gas from a suction port to be taken into the ventral and dorsal closed spaces and compressed and discharged from a discharge port, and such that an innermost closed space is formed during revolution by combining the dorsal and ventral closed spaces for discharge to the discharge port;

wherein each of said first and second central end portions of said first and second spiral wraps form complete engagement profiles by which the volume of the innermost closed space can become substantially zero during revolution of said swivel scroll;

wherein each of said first and second central end portions of said first and second spiral wraps have a step-shaped sectional profile that comprises at least two steps, said complete engagement profiles comprising said step-shaped sectional profiles; and wherein at least one step of said at least two steps of said step-shaped sectional profile of each of said first and second central end portions of said first and second spiral wraps has a shape in which a contact angle of a dorsal involute curve thereof and a central portion curve thereof and a contact angle of a ventral involute curve thereof and said central portion curve thereof are different from each other.

8. The arrangement of claim 7, wherein said first and second spiral wraps have said step-shaped sectional profiles only at said first and second central end portions thereof, whereby a majority of said first and second spiral wraps are free from steps.

9. The arrangement of claim 7, wherein, with respect to both said stationary scroll and said swivel scroll, said contact angle of said dorsal involute curve and said central portion curve is smallest at the one of said at least two steps that is closest to the one of said first and second end plates which the one of said first and second spiral wraps comprising the one of said at least two steps is on; and wherein, with respect to both said stationary scroll and said swivel scroll, said contact angle of said ventral involute curve and said central portion curve is largest at the one of said at least two steps that is closest to the one of said first and second end plates which the one of said first and second spiral wraps comprising the one of said at least two steps is on and smallest at the one of said at least two steps that is furthest from the one of said first and second end plates which the one of said first and second spiral wraps comprising the one of said at least two steps is on.

10. The arrangement of claim 9, wherein the smallest value of said contact angle of said dorsal involute curve and said central portion curve of said second spiral wrap is smaller than the smallest value of said contact angle of said dorsal involute curve and said central portion curve of said first spiral wrap.

11. The arrangement of claim 10, wherein a profile only of the one of said at least two steps of said second spiral wrap that is closest to said second end plate, wherein said contact angle of said dorsal involute curve and said central portion is smallest, is an incomplete engagement profile, in which a disengagement is formed at a connecting point so that gas is passable to an adjacent circumferentially outer compression chamber; and wherein a profile only of the one of said at least two steps of said first spiral wrap that is furthest from said first end plate, wherein said contact angle of said dorsal involute curve and said central portion is largest, is an incomplete engagement profile, in which a disengagement is formed at a connecting point so that gas is passable to an adjacent circumferentially outer compression chamber.

12. The arrangement of claim 7, wherein ones of said at least two steps of said sectional profiles of said first and second central end portions of said first and second spiral wraps that are closest to their respective said end plates are on ventral sides of said first and second spiral wraps, respectively.

13. The arrangement of claim 12, wherein said spiral wraps each have a dorsal involute curve, a central portion curve and a ventral involute curve, and the ones of said at least two steps extend along said ventral involute curve and said central portion curve.

* * * * *